United States Patent [19]

McLaughlin

[11] Patent Number: 4,611,970

[45] Date of Patent: Sep. 16, 1986

[54] APPARATUS FOR REMOVING WATER FROM THE GROUND

[76] Inventor: Hugh R. McLaughlin, Aberdour, Bray Road, Foxrock, Dublin 18, Ireland

[21] Appl. No.: 738,730

[22] Filed: May 29, 1985

[30] Foreign Application Priority Data

May 30, 1984 [IE] Ireland ..... 1363/84

[51] Int. Cl.[4] ..... F04D 23/00

[52] U.S. Cl. ..... 415/6; 415/5; 415/92

[58] Field of Search ..... 415/92.6, 5, 121 G, 415/121 R

[56] References Cited

U.S. PATENT DOCUMENTS

| | | | |
|---|---|---|---|
| 1,238,115 | 8/1917 | Dreisbach | 415/6 |
| 4,245,473 | 1/1981 | Sandoval | 415/92 |
| 4,296,602 | 10/1981 | Hales et al. | 415/92 |

FOREIGN PATENT DOCUMENTS

| | | | |
|---|---|---|---|
| 120656 | 3/1984 | European Pat. Off. | 415/6 |
| 2619407 | 11/1977 | Fed. Rep. of Germany . | |
| 2907655 | 9/1980 | Fed. Rep. of Germany | 415/92 |

*Primary Examiner*—Robert E. Garrett
*Assistant Examiner*—John Kwon
*Attorney, Agent, or Firm*—Sughrue, Mion, Zinn, Macpeak and Seas

[57] ABSTRACT

An apparatus for the removal of water from the ground includes a rotatable outer cylinder apertured around its circumference, and a non-rotating part cylindrical member concentric with, and immediately inside the cylinder. The part cylindrical member is open in the region of ground contact. A plurality of sweeper blades are mounted inside the outer cylinder for rotation relative thereto while the outer cylinder is rotating. The blades sweep ground water received through the apertures of the outer cylinder upwardly for trapping between the blades and the part cylindrical member. At a certain height the ground water is discharged into a non-rotating tank inside the outer cylinder.

8 Claims, 4 Drawing Figures

APPARATUS FOR REMOVING WATER FROM THE GROUND

This invention concerns an apparatus for the removal of surface water and limited sub-surface water from the ground, the floor or the like surfaces hereinafter referred to collectively as the ground. For example the apparatus is adapted to remove water from sports fields including football pitches, athletic grounds, cricket grounds, bowling greens, race tracks, golf courses and is particularly suitable for use with grass covered surfaces.

Sporting events are frequently cancelled or abandoned due to water logging. Others are held in very soggy conditions to the disadvantage of the sport concerned both from the player's and spectator's points of view.

Plastic sheeting has been tried unsuccessfully as a method of protecting the ground but the main difficulty here has been removing the plastic sheeting, with the weight of water on it. Also of course, plastic sheeting cannot withstand even moderate winds without lifting and/or tearing. This is combined with the failure to find a satisfactory method of joining the sheets to avoid seepage at the joints.

Accordingly the present invention provides an apparatus for the removal of water from the ground, including a ground engaging drum comprising an outer hollow cylinder mounted for rotation about a horizontal axis, a plurality of apertures distributed around the circumference of the outer cylinder, a non-rotating part cylindrical member concentric with and mounted immediately inside the outer cylinder, the part cylindrical member being open in the region of ground contact of the drum to permit receipt of ground water through the apertures in the outer cylinder, a plurality of elements disposed within the outer cylinder and mounted for rotation concentric therewith, means for effecting rotation of the said plurality of elements relative to the outer cylinder during rotation of the latter, the said elements engaging the inside surface of the outer cylinder and the part cylindrical member in such manner as to sweep ground water received through the apertures upwardly away from the ground for trapping between the said elements and the part cylindrical member, and a non-rotating water tank mounted within the outer cylinder into which water swept upwards by the said elements is discharged at a certain height.

Figure 1:
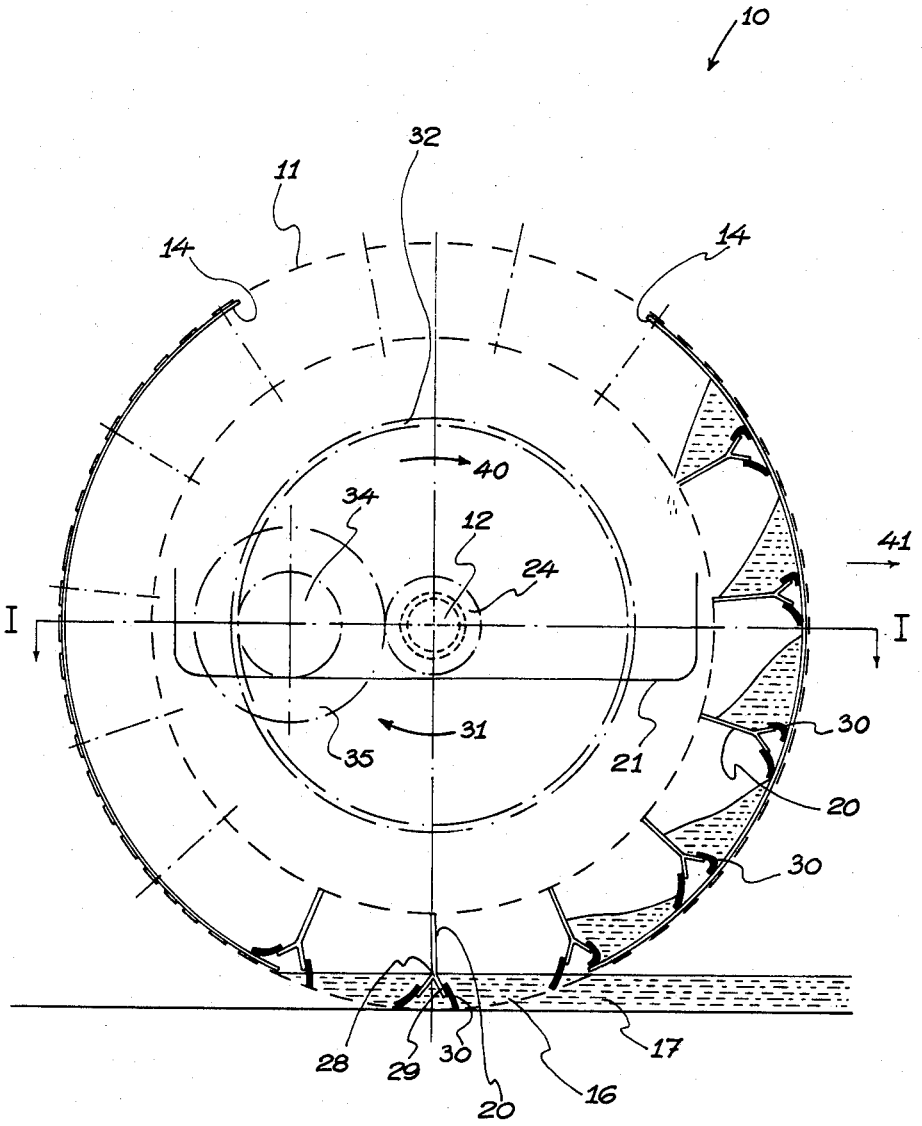
Figure 2:
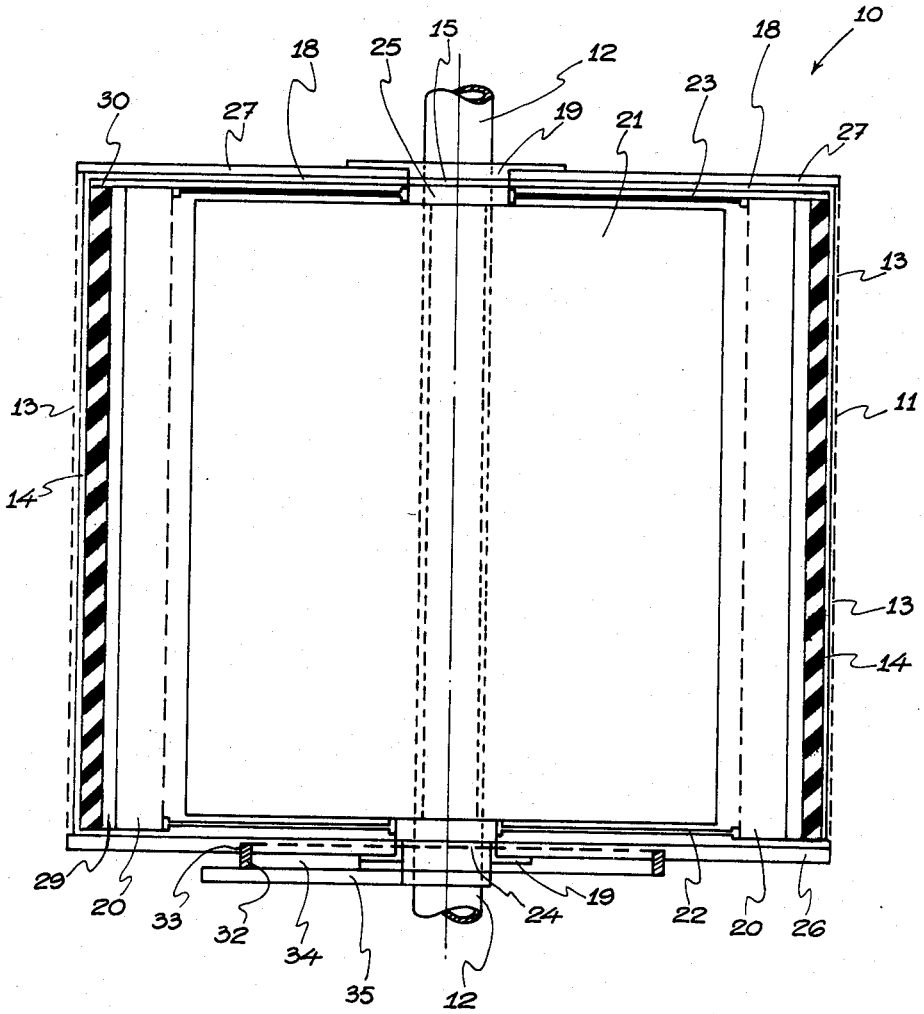
Figure 3:
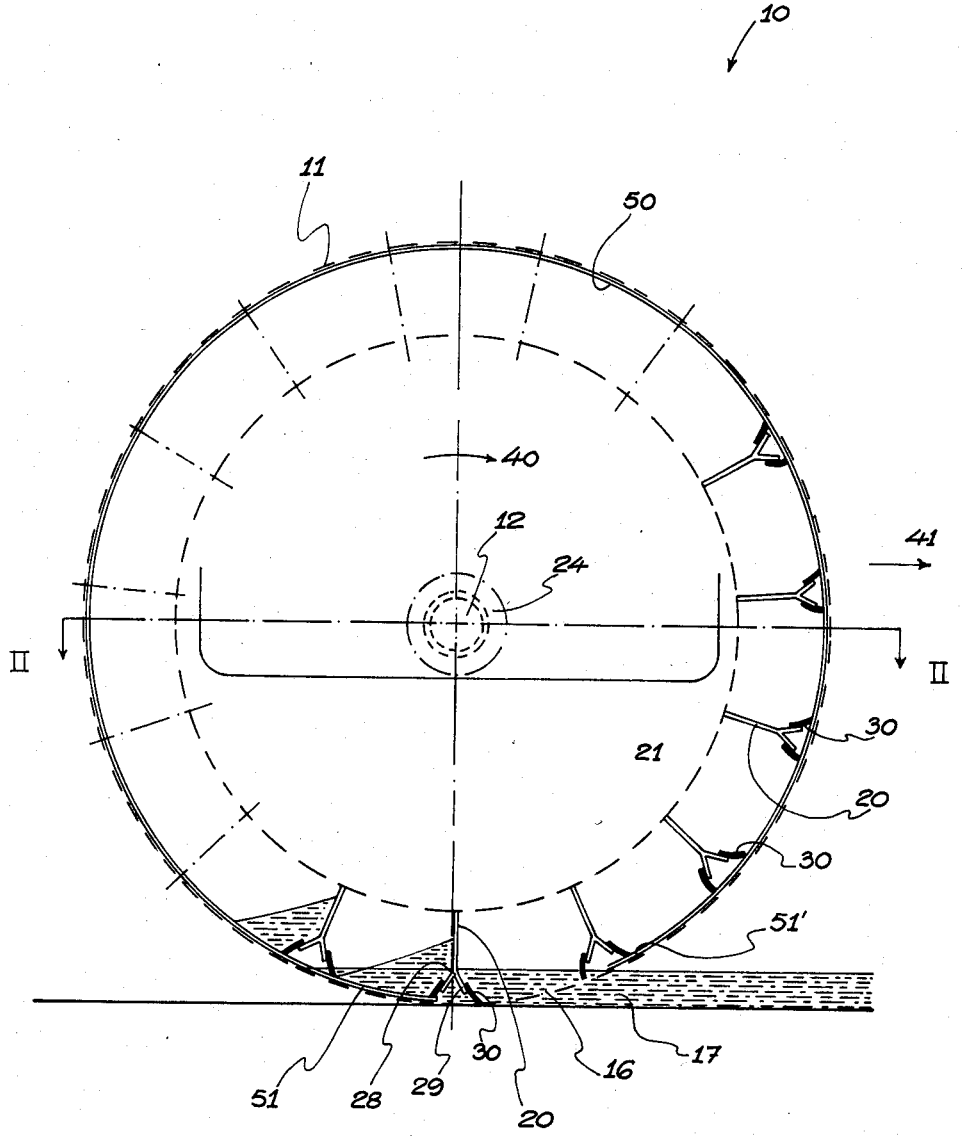
Figure 4:
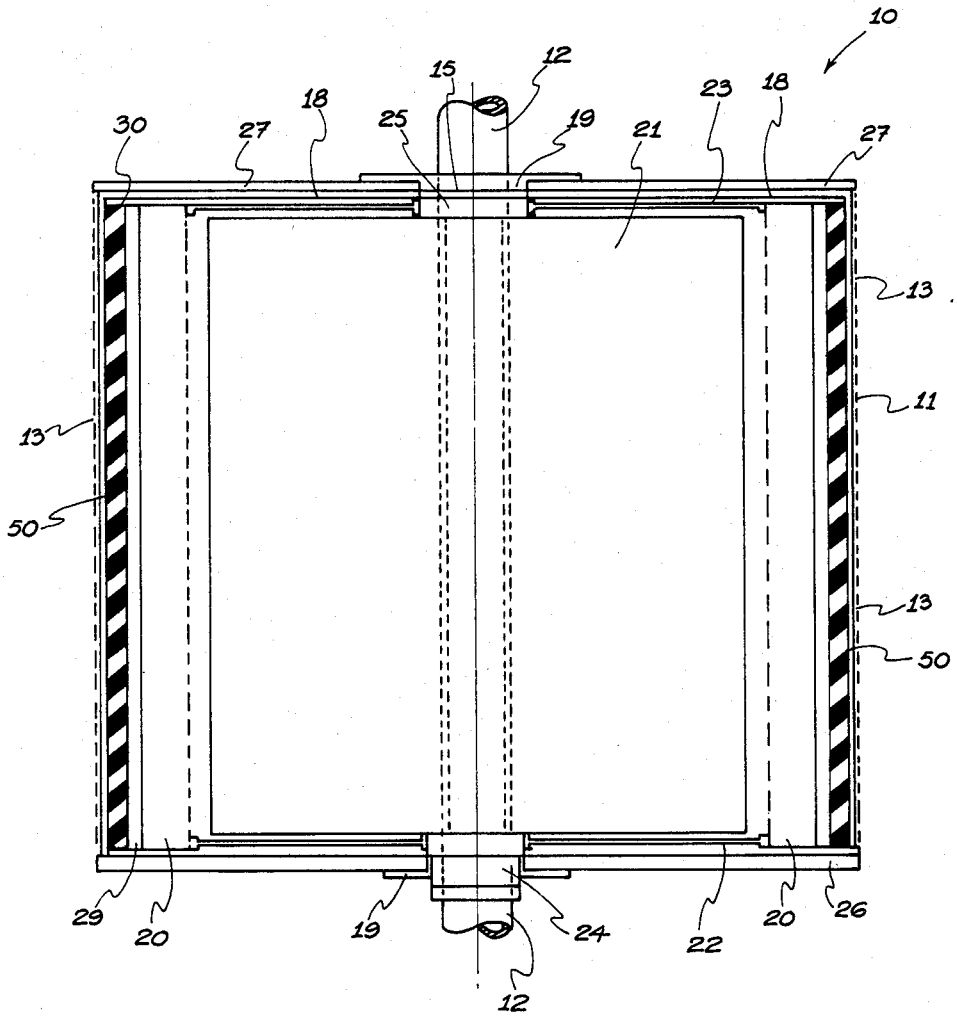

Embodiments of the invention will now be described by way of example with reference to the accompanying drawings in which:

FIG. 1 is a diagrammatic cross-sectional side view of a first embodiment of the invention, FIG. 2 is a cross-sectional plan view taken along the line I—I in FIG. 1, FIG. 3 is a diagrammatic cross-sectional side view of a second embodiment of the invention; and FIG. 4 is a cross-sectional plan view taken along the line II—II in FIG. 3.

It will be understood that in general the construction and operation of the support framework and drive motor of the embodiments of the present invention may be similar of that described in European Patent Specification No. O120656A.

Accordingly, the following description is primarily concerned with the construction of the ground engaging drum which incorporates the major differences between the present apparatus and that of European Patent Specification No. 0120656A.

Referring now to FIGS. 1 and 2, there is shown therein an apparatus according to a first embodiment of the invention comprising a ground engaging drum 10 mounted in a frame (not shown) for rotation about a horizontal axis. More specifically, the drum 10 comprises an outer hollow cylinder 11 of stainless steel or extruded PVC which is rotatably mounted via bearings 19 on a fixed horizontal shaft 12, the latter passing coaxially through the outer cylinder 11 and being supported at each end in respective mountings carried at opposite sides of the frame. On one side (the upper side as seen in FIG. 1) the bearing 19 is mounted directly on the fixed shaft 12, whereas on the other side the bearing 19 is mounted on a hub 24 permitting rotation of the cylinder 11 relative to the hub. The shaft 12 is hollow and apertured around its circumference.

The outer cylinder 11 is apertured around its circumference, the apertures 13 either being circular, or more preferably elongate slots parallel to the cylinder axis. The apertures 13 preferably represent about one half of the total circumferential area of the cylinder 11. A pair of mutually opposed non-rotating substantially half cylinder members 14 are adjustably fixedly mounted on a bushing 15 by means of radial support members 18, the bushing 15 being fixed relative to the shaft 12. The half cylinder members 14 are located immediately inside the outer cylinder 11 and are spaced apart in the region of ground contact 16 to permit receipt of ground water 17 through the apertures 13 in the outer cylinder 11.

A plurality of sweeper blades 20 each extending substantially the full axial length of the cylinder 11 are disposed in the radial gap between the outer cylinder 11 and a water tank 21. The sweeper blades 20 are preferably spaced apart by approximately four inches. Each sweeper blade 20 is supported at opposite ends by a pair of arms 22, 23 which are fixedly mounted on respective hubs 24, 25 adjacent the outer cylinder sides 26, 27 respectively. The hubs 24, 25 are rotatably mounted in conventional manner on the fixed horizontal shaft 12 whereby the blades 20 may be rotated within and relative to the cylinder 11. The end 28 of each sweeper blade 20 is bifurcated, each branch 29 of the bifurcated end having a resilient rubber strip 30 which engages during rotation of the sweeper blade 20 with the inside surface of the outer cylinder 11 and the inside surface of the half cylinder members 14. It will be understood that the tank 21 is fixed to the shaft 12 and does not rotate with the cylinder 11. The outer cylinder 11 and the sweeper blades 20 are in use rotated in opposite directions by means of a gearing mechanism 31 as follows. An internally toothed annular gear wheel 32 concentric with the cylinder 11 is partially and non-rotatably inset into the side 26 of the outer cylinder 11 as indicated at 33. The internal teeth of the gear wheel 32 are meshed with a further gear wheel 34. A drive gear wheel 35, driven by a petrol engine in any suitable manner, is non-rotatably fixed to the gear wheel 34 and meshes with external teeth (not shown) on the hub 24 to rotate the hub 24 and consequently the sweeper blades 20 in the opposite direction of rotation to the direction of rotation of the outer cylinder 11.

The apparatus operates as follows. When the engine (not shown) is running the drive wheel 35 is rotated clockwise in the direction of arrow 40 which causes the gear wheel 34 to rotate the outer cylinder 11, via the gear wheel 32, also in the clockwise direction. The drum 10 is thus propelled forwardly in the direction of arrow 41. At the same time the gear wheel 35 rotates the hub 24 in the anticlockwise direction via the external teeth on the hub 24. Thus the hub 24 and the sweeper blades 20 rotate in the opposite direction relative to the outer cylinder 11. As the cylinder 11 is propelled forward ground water 17 enters the cylinder 11 through the apertures 13 and is swept upwards by the sweeper blades 20, the resilient rubber strips 30 ultimately engaging against the right hand half cylinder member 14. When the resilient rubber strips 30 encounter the half cylinder member 14, the tip of each strip 30 is deformed slightly backwards relative to the direction of rotation to form a seal against the half cylinder member 14 thereby trapping the ground water between the blades 20 and the member 14. When the sweeper blades 20 pass a notional horizontal centre plane intersecting the axis of the drum 10 the water carried by each sweeper blade 20 is discharged into the water tank 21. When the water in the tank 21 rises to the level of the shaft 12 it flows into the shaft 12 through the apertures therein and out through both ends of the shaft 12 into tubes (not shown) that convey the water to a collection tank (not shown) mounted on the frame whereafter it may be discharged by any suitable means.

It will be appreciated that if the direction of rotation of the outer cylinder 11 is reversed the direction of rotation of the sweeper blades 20 is also reversed. Thus ground water can be removed in either direction of rotation of the drum 10. The contra-rotation of the sweeper blades 20 relative to the outer cylinder 11 permits a slower rate of rotation of the sweeper blades, in the absolute sense, than if the blades rotated in the same direction as the cylinder 11. However, it will be understood that the sweeper blades 20 could be adapted to rotate in the same direction as, but faster than, the outer cylinder 11 and efficiently remove ground water 17. As provided by the gearing mechanism 31 in the embodiment described above, for efficient operation it is desirable that the sweeper blades 20 rotate substantially faster than the outer cylinder 11.

Furthermore, it will be understood that the drum 10 may include on the outer cylinder 11 a covering of a resilient foam or rubber material for the purpose of protecting the ground over which it may travel. In this case the foam or rubber material would also be apertured and the apertures would be in register with the apertures 13 in the outer cylinder 11 to allow a free flow of ground water into the cylinder 11. The foam or rubber covering when compressed in the region of ground contact would preferably be approximately one eighth of an inch thick.

Alternatively, the outer cylinder 11 could be covered for the purpose of drying ground. This is achieved by covering the outer surface of the cylinder 11 with a cellular foam material having apertures as described above. As the cellular foam material would absorb water into its fibres without compression only a minimal thickness of such material would be required to absorb any residue of water or moisture to the rear of the centre point of ground contact of the cylinder. Thereafter, water absorbed by the cellular foam material would be carried around the cylinder to the top where it is discharged into the water tank by compressing the cellular foam material with a pressure roller in known manner.

Referring now to FIGS. 3 and 4 there is shown therein another embodiment of the invention, in which the same numerals have been used to indicate the same or similar parts in FIGS. 1 and 2.

Instead of the half cylinder members 14 of the previous embodiment there is now a single almost complete part cylindrical member 50 located immediately inside the outer cylinder 11 but which is open in the region of ground contact 16. The cylindrical member 50 on one side 51 extends downwards almost to a notional vertical plane intersecting the axis of the drum 10, i.e. substantially to the line of ground contact. The cylindrical member 50 is adjustably mounted on the bushing 15 by means of radial support members 18. A gearing mechanism (not shown) is used to rotate the cylinder 11 in the direction of the arrow 40 and to rotate the sweeper blades 20 in the same direction at a substantially faster rate.

The operation of this second embodiment of the invention is as follows. The cylinder 11 is rotated in the direction of arrow 40 and is thus propelled forwardly in the direction of arrow 41. At the same time the sweeper blades 20 are rotated in the same direction as the cylinder 11 but at a greater rotational speed. Thus, the sweeper blades 20 sweep ground water 17 upwards away from the region of ground contact 16 of the drum 10 as described previously. The advantage of this embodiment of the invention is that in the region of ground contact 16 the sweeper blades 20 are moving in a direction opposite to that of the forward motion of the drum 10. Thus, there is little tendency for the sweeper blades 20 to push the ground water 17 out of the interior of the cylinder 11 since the side 51 of the part cylindrical member 50 extends almost to ground level. If the direction of movement of the drum 10 is reversed then the position of the part cylindrical member 50 may be changed by rotating it clockwise approximately 20° so that the side 51' is moved downwards to the notional vertical plane intersecting the axis of the drum 10. In this case the rotational direction of the sweeper blades 20 is also reversed. It will be understood that the bushing 19 may be locked in suitable manner to maintain the part cylindrical member 50 in the desired position.

It will be understood that the present invention may be advantageously employed with the air jet means described in Irish Provisional Patent Application No. 1364/84.

The invention is not limited to the embodiments described above which may be modified and varied without departing from the scope of the invention.

I claim:

1. An apparatus for the removal of water from the ground, including a ground engaging drum comprising an outer hollow cylinder mounted for rotation about a horizontal axis, a plurality of apertures distributed around the circumference of the outer cylinder, a non-rotating part cylindrical member concentric with and mounted immediately inside the outer cylinder, the part cylindrical member being open in the region of ground contact of the drum to permit receipt of ground water through the apertures in the outer cylinder, a plurality of elements disposed within the outer cylinder and mounted for rotation concentric therewith, means for effecting rotation of the said plurality of elements relative to the outer cylinder during rotation of the latter, the said elements engaging the inside surface of the outer cylinder and the part cylindrical member in such manner as to sweep ground water received through the apertures upwardly away from the ground for trapping between the said elements and the part cylindrical member, and a non-rotating water tank mounted within the outer cylinder into which water swept upwards by the said elements is discharged at a certain height.

2. An apparatus according to claim 1, wherein the said elements are adapted to rotate in the opposite direction to the direction of rotation of the outer cylinder.

3. An apparatus according to claim 1, wherein the said elements are adapted to rotate in the same direction as the direction of rotation of the outer cylinder but at a faster rate.

4. An apparatus according to claim 2 or 3, wherein a pair of mutually opposed part cylindrical members are mounted inside the outer cylinder, the part cylindrical members being spaced apart in the region of ground contact and extending above the height of the water tank.

5. An apparatus according to claim 3, wherein the part cylindrical member extends substantially to the line of ground contact on that side of the outer cylinder towards which the said elements move in the region of ground contact during rotation of the outer cylinder.

6. An apparatus according to claim 1, wherein each of the said plurality of elements comprises a sweeper blade disposed between the water tank and the outer cylinder and mounted on a pair of support arms rotatable about the said horizontal axis.

7. An apparatus according to claim 6, wherein each sweeper blade is bifurcated, each bifurcation having a resilient strip which during rotation of the blade engages the inside surfaces of the part cylindrical member and the outer cylinder.

8. An apparatus according to claim 1, wherein the drum further includes a covering of resilient material on the outer cylinder having apertures in register with the apertures in the outer cylinder.

* * * * *